US007564428B2

(12) United States Patent
Chung et al.

(10) Patent No.: US 7,564,428 B2
(45) **Date of Patent: *Jul. 21, 2009**

(54) PLASMA DISPLAY PANEL AND METHOD FOR DRIVING THE SAME

(75) Inventors: Woo-Joon Chung, Ahsan (KR); Jin-Sung Kim, Cheonan (KR); Kyoung-Ho Kang, Suwon (KR); Seung-Hun Chae, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 419 days.

This patent is subject to a terminal disclaimer.

(21) Appl. No.: 11/278,912

(22) Filed: Apr. 6, 2006

(65) Prior Publication Data

US 2006/0164340 A1 Jul. 27, 2006

Related U.S. Application Data

(63) Continuation of application No. 10/844,544, filed on May 13, 2004.

(30) Foreign Application Priority Data

May 14, 2003 (KR) ..... 2003-30652

(51) Int. Cl.
*G09G 3/28* (2006.01)

(52) U.S. Cl. ..... 345/60; 345/62; 345/66

(58) Field of Classification Search ..... 345/60–68, 345/204; 315/169.4
See application file for complete search history.

(56) References Cited

U.S. PATENT DOCUMENTS 5,150,011 A 9/1992 Fujeda
5,745,086 A 4/1998 Weber
6,195,072 B1 2/2001 Iwami
6,590,345 B2 7/2003 Myoung et al.
6,653,993 B1 11/2003 Nagao et al.
7,012,579 B2 3/2006 Choi
7,355,564 B2 4/2008 Kang et al.
2002/0180669 A1 12/2002 Kim et al.
2003/0117384 A1 * 6/2003 Lee et al. ..... 345/204

(Continued)

FOREIGN PATENT DOCUMENTS

CN 1410960 4/2003

(Continued)

OTHER PUBLICATIONS

K. Sakita, et al., "10.3: Analysis of a Weak Discharge of Ramp-Wave Driving to Control Wall Voltage and Luminance in AC-PDPs", 2000 SID International Symposium, vol. XXXI, May 18, 2000, p. 110-113.

(Continued)

*Primary Examiner*—Regina Liang
(74) *Attorney, Agent, or Firm*—H.C. Park & Associates, PLC

(57) ABSTRACT

Disclosed is a reset waveform of a plasma display panel. A rising or falling voltage is applied rapidly enough to cause an intense discharge in a reset interval. The electrodes are then floated to reduce the voltage applied into a discharge space during the discharge to cause a self-quenching of the discharge, thereby precisely controlling wall charges.

28 Claims, 11 Drawing Sheets

U.S. PATENT DOCUMENTS

| | | | |
|---|---|---|---|
| 2005/0052354 | A1 | 3/2005 | Chae et al. |
| 2005/0057443 | A1 | 3/2005 | Whang et al. |

FOREIGN PATENT DOCUMENTS

| | | |
|---|---|---|
| JP | 08-320669 | 12/1996 |
| JP | 11-052909 | 2/1999 |
| JP | 11338417 | 12/1999 |
| JP | 2001005422 | 1/2001 |
| JP | 2001-318649 | 11/2001 |
| JP | 2002-082648 | 3/2002 |
| JP | 2002-132208 | 5/2002 |
| JP | 2002-258794 | 9/2002 |
| JP | 2003-029700 | 1/2003 |
| JP | 2003-058105 | 2/2003 |
| JP | 2003-084712 | 3/2003 |
| JP | 2004-198777 | 7/2004 |

OTHER PUBLICATIONS

European Search Report dated Nov. 20, 2007.
Office Action dated Aug. 3, 2007 (for Co-Pending U.S. Appl. No. 10/844,544).
Office Action dated Jan. 23, 2008 (for Co-Pending U.S. Appl. No. 10/844,544).
Office Action dated Jun. 10, 2008 (for Co-Pending U.S. Appl. No. 10/844,544).
Office Action dated Jan. 26, 2009 (for co-pending U.S. Appl. No. 11/278,921).
Office Action dated Nov. 28, 2008 (for co-pending U.S. Appl. No. 10/844,544).
Office Action dated Mar. 25, 2009 (for co-pending U.S. Appl. No. 10/844,544).
Office Action dated Jan. 26, 2009 (for co-pending U.S. Appl. No. 11/278,921).

* cited by examiner

PLASMA DISPLAY PANEL AND METHOD FOR DRIVING THE SAME

CROSS REFERENCE TO RELATED APPLICATIONS

This application is a continuation of prior U.S. patent application Ser. No. 10/844,544, filed on May 13, 2004, which claims priority to and the benefit of Korea Patent Application No. 2003-30652, filed on May 14, 2003, both of which are hereby incorporated by reference for all purposes as if fully set forth herein.

BACKGROUND OF THE INVENTION

1. Field of the Invention

This invention relates to a plasma display panel (PDP) and a method for driving the same. More specifically, the present invention relates to a reset waveform driving method for PDP.

2. Description of the Related Art

Flat panel displays, such as, liquid crystal displays (LCDs), field emission displays (FEDs), PDPs, and the like are actively being developed. PDPs generally have higher luminance, higher luminous efficiency and wider viewing angles than other flat panel displays. Thus, PDPs are more favorable for making large-scale screens of 40 inches or more than, for example, the conventional cathode ray tube (CRT).

A PDP is a flat panel display that uses plasma, which is generated by gas discharge, to display characters or images and includes, according to its size, more than several scores to millions of pixels arranged in a matrix pattern. A PDP may be classified as direct current (DC) type or alternating current (AC) type according to the PDP's discharge cell structure and the waveform of the driving voltage applied thereto.

A DC type PDP has electrodes exposed to a discharge space to allow a direct current (DC) to flow through the discharge space while the voltage is applied, and thus, DC type PDPs generally require a resistor to provide resistance for limiting the current. In contrast, an AC type PDP has electrodes covered with a dielectric layer, which forms a capacitance component, to limit the current and which protects the electrodes from the impact of ions during a discharge. Thus, AC type PDPs generally have longer lifetimes than DC type PDPs.

FIG. 1 is a partial perspective view of an AC type PDP. FIG. 1 shows a first glass substrate 1, parallel pairs of a scan electrode 4 and a sustain electrode 5, a dielectric layer 2 and a protective layer 3. On a second glass substrate 6, a plurality of address electrodes 8, which are covered with an insulating layer 7, are arranged. Barrier ribs 9 are formed in parallel with the address electrodes 8 on the insulating layer 7, which is interposed between the address electrodes 8. A fluorescent material 10 is formed on the surface of the insulating layer 7 and on both sides of the barrier ribs 9. The first and second glass substrates 1 and 6 are arranged in a face-to-face relationship with a discharge space 11 formed therebetween, so that the scan electrodes 4 and the sustain electrodes 5 lie in a direction perpendicular to the address electrodes 8. Discharge spaces at intersections between the address electrodes 8 and the pairs of scan electrode 4 and sustain electrode 5 form discharge cells 12.

FIG. 2 shows an arrangement of electrodes in the PDP.

Referring to FIG. 2, the PDP has a pixel matrix consisting of m×n discharge cells. In the PDP, address electrodes $A_1$ to $A_m$ are arranged in columns and scan electrodes (Y electrodes) $Y_1$ to $Y_n$ and sustain electrodes (X electrodes) $X_1$ to $X_n$ are alternately arranged in n rows. Discharge cells 12 shown in FIG. 2 correspond to the discharge cells 12 in FIG. 1.

According to the general PDP driving method, one frame is divided into a plurality of subfields, each of which is comprised of a reset period, an address period, and a sustain period.

During the reset (initialization) period, the state of wall charges from the previous sustain period are erased and the wall charges are set up in order to stably perform the next address discharge. Generally, the reset period is for preparing the optimal state of the wall charges for the addressing operation during the address period subsequent to the reset period.

The address period is for selecting turn-on cells and turn-off cells and accumulating wall charges on the turn-on cells (i.e., addressed cells). The sustain period is for performing a discharge to display an image on the addressed cells.

The reset period of the conventional driving method involves applying a ramp waveform as disclosed in U.S. Pat. No. 5,745,086. In the conventional driving method, a slowly rising or falling ramp waveform is applied to the Y electrodes to control the wall charges of each electrode during the reset period. However, the precise control of the wall charges is greatly dependent upon the slope of the ramp in the ramp waveform that is applied. Thus, in order to precisely control the wall charges, generally, a long time is required for initialization.

SUMMARY OF THE INVENTION

This invention provides a plasma display panel and its driving method that implements initialization in a short time.

Additional features of the invention will be set forth in the description which follows, and in part will be apparent from the description, or may be learned by practice of the invention.

The present invention discloses a method for driving a plasma display panel which includes a first electrode, a second electrode, a third electrode, and a discharge space defined by the first electrode, the second electrode, and the third electrode, the method including applying a first voltage to the first electrode to discharge the discharge space, and floating the first electrode.

The present invention also discloses a method for driving a plasma display panel, which includes a first space defined by a first electrode, a second electrode and a third electrode, the method including applying a time-varying voltage to the first electrode to discharge the first space, and floating the first electrode after applying the time-varying voltage.

The present invention also discloses a method for driving a plasma display panel, which includes a first space defined by a scan electrode, a sustain electrode and an address electrode, the method including, during a reset period, applying a rising voltage to the scan electrode, floating the scan electrode after applying the rising voltage to the scan electrode, applying a falling voltage to the scan electrode, and floating the scan electrode after applying the falling voltage to the scan electrode.

The present invention also discloses a method for driving a plasma display panel, which includes a first space defined by a first electrode, a second electrode and a third electrode, the method including, during a reset period, performing a first discharge in the first space, quenching the first discharge, performing a second discharge in the first space, and quenching the second discharge.

The present invention also discloses a plasma display panel including a first substrate and a second substrate, scan electrode, a sustain electrode, and an address electrode, a first space defined by the scan electrode, the sustain electrode and the address electrode, and a driver circuit for sending a driving signal to the scan electrode, the sustain electrode and the address electrode during a reset period, an address period, and a sustain period, the driver circuit, during the reset period, applying a time-varying voltage to the scan electrode to discharge the first space, and floating the scan electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
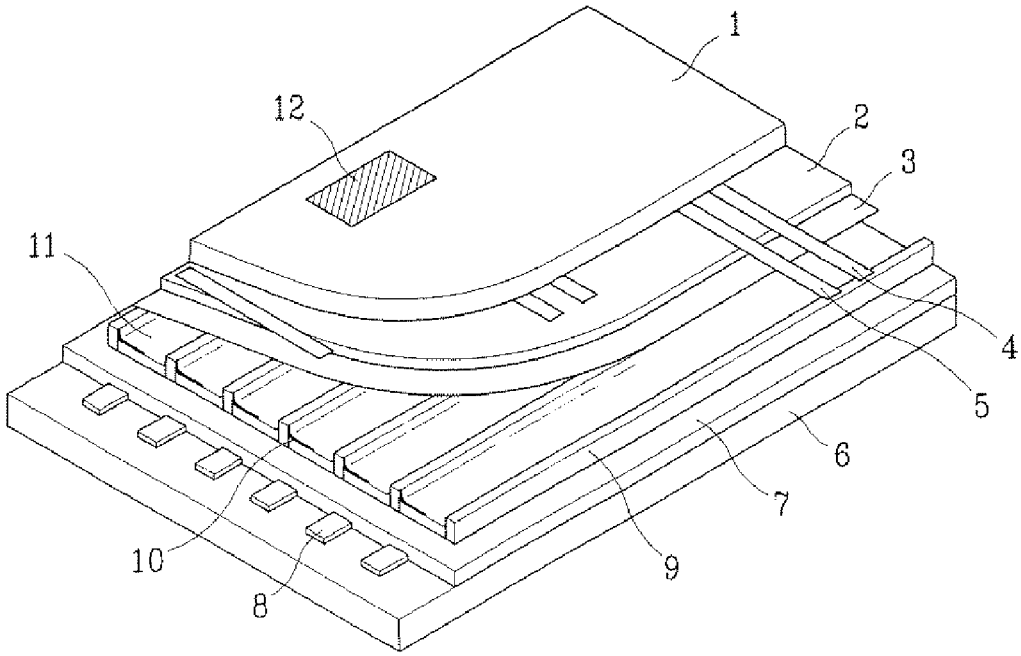
FIG. 1 is a partial perspective of an AC type PDP.
Figure 2:
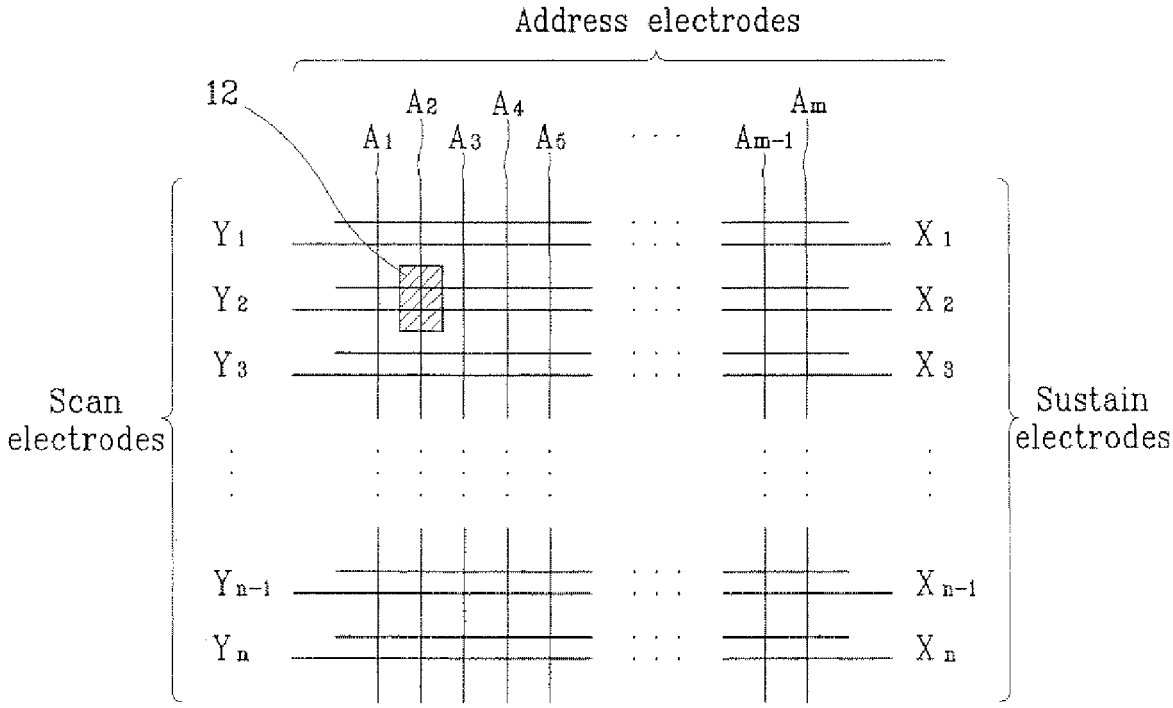
FIG. 2 illustrates an arrangement of electrodes in the PDP.

In the following detailed description, only the exemplary embodiments of the invention have been shown and described. As will be realized, the invention is capable of modification in various obvious respects, all without departing from the invention. Accordingly, the drawings and description are to be regarded as illustrative in nature, and not restrictive.

The method for driving a plasma display panel according to an embodiment of the present invention involves increasing or decreasing an applied voltage rapidly enough to cause an intense discharge during a reset period and then reducing a voltage applied to the inside of a discharge space during the discharge to cause a self-quenching of the discharge, thereby controlling wall charges. According to the embodiment of the present invention, the self-quenching of the discharge can be implemented using the floating state of electrodes.

A predetermined time period called a "discharge delay" is the time period after application of a voltage until discharge of a discharge space. The process beginning after application of a voltage until a discharge will be described below.

When at least one of the two electrodes (two of X and Y electrodes and address electrodes) represented by a capacitive load is coupled to a power source, the two electrodes are charged with electric charges and a voltage is applied to a discharge space (i.e., between the two electrodes). When the voltage is applied to the discharge space, a discharge occurs through alpha and gamma processes and wall charges accumulate on the dielectric layers of the two electrodes. The accumulated wall charges reduce the voltage applied to the inside of the discharge space. As a considerable quantity of wall charges accumulate, the voltage applied to the discharge space is diminished as the wall charges gradually quench the discharge.

The following scenarios may take place for this process.

In the first scenario, the electrodes of the plasma display panel are coupled to the power source during substantially the whole discharge period as in the reset method of the prior art.

As a discharge occurs, wall charges accumulate on the dielectric layers formed in the electrodes. However, the voltage of the electrodes is maintained substantially constant with the applied voltage, because electric charges are continuously being supplied from the power source. The quantity of electric charges supplied to the electrodes from the power source is almost equal to that of wall charges accumulated by the discharge, so the internal voltage drop of the discharge space caused by the wall charges is very insignificant. Accordingly, a considerable amount of accumulated wall charges are needed to quench the discharge.

In the second scenario, the electrodes are floated after applying a voltage and the electrodes are electrically isolated from the power source as in the embodiment of this invention.

As a discharge occurs and wall charges accumulate, the voltage of the electrodes is changed according to the quantity of the accumulated wall charges because there is no electric charge supplied to the electrodes from the power source. The quantity of the accumulated wall charges reduces the internal voltage of the discharge space, so the discharge is quenched with a small quantity of wall charges. When a predetermined voltage is applied to the electrodes and then the power source and the panel are put in an open-circuit (high impedance) condition to float the electrodes, the voltage between the electrodes is reduced with a decrease in the internal voltage of the discharge space by the accumulation of the wall charges, thereby quenching the discharge with a small quantity of the wall charges. Accordingly, the wall charges can be controlled more precisely by floating the electrodes than by applying a voltage to the electrodes.

Now, the principle of the driving method according to an embodiment of the present invention will be described in further detail with reference to FIGS. 3A, 3B, 4, 5 and 6.

Figure 3A:
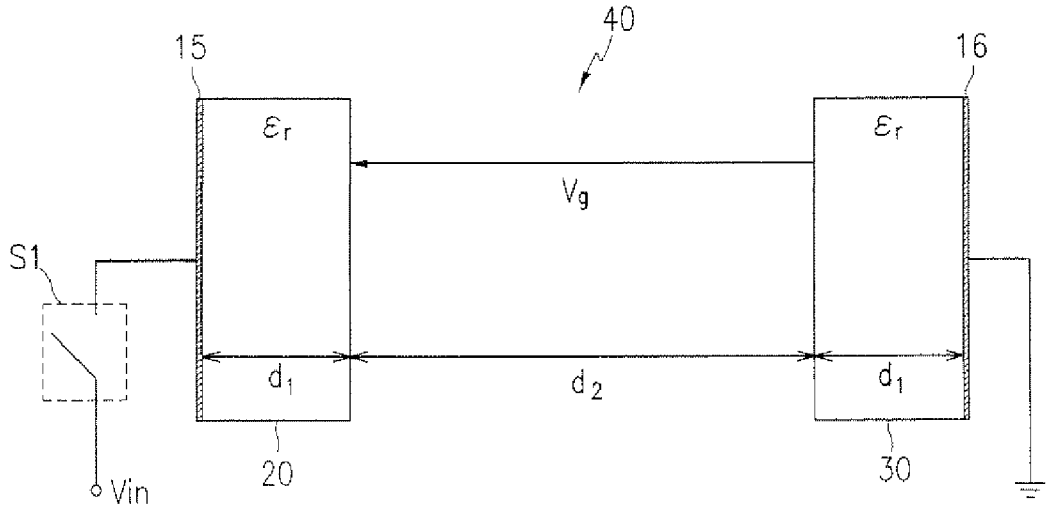
FIG. 3A shows a model of a plasma display cell for describing a driving method according to an embodiment of the present invention.
Figure 3B:
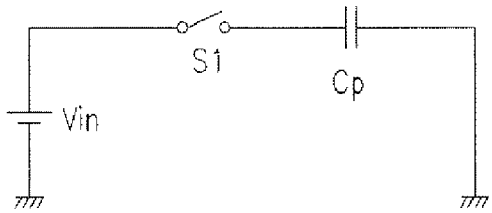
FIG. 3B is an equivalent circuit diagram of FIG. 3A.

FIG. 3A shows the one-dimensional model of a PDP cell for explaining the driving method according to the embodiment of this invention, and FIG. 3B is an equivalent circuit diagram of FIG. 3A.

Referring to FIG. 3A, a first electrode (e.g., Y electrodes) 15 is coupled to a voltage $V_{in}$ through a switch $S_1$, and a second electrode (e.g., X electrodes) 16 is coupled to a ground voltage. Dielectrics 20 and 30 are formed on the first and second electrodes 15 and 16, respectively. Between the dielectrics 20 and 30 a discharge gas (not shown) is injected, and the region between the dielectrics 20 and 30 is defined as a discharge space 40.

The first electrode 15 and the second electrode 16, the dielectrics 20 and 30, and the discharge space 40 are represented as a panel capacitance Cp in the equivalent circuit diagram of FIG. 3B.

In FIG. 3A, the two dielectrics 20 and 30 are of the same thickness $d_1$ and are separated from each other at a predetermined distance (the distance of the discharge space) $d_2$. The dielectric constant of the two dielectrics 20 and 30 is $\epsilon_\gamma$, and the voltage applied to the discharge space 40 is $V_g$.

Next, reference will be made to FIG. 4 to calculate the voltage $V_g$ applied to the discharge space when the voltage $V_{in}$ is applied to the electrodes without accumulating wall charges.

Figure 4:
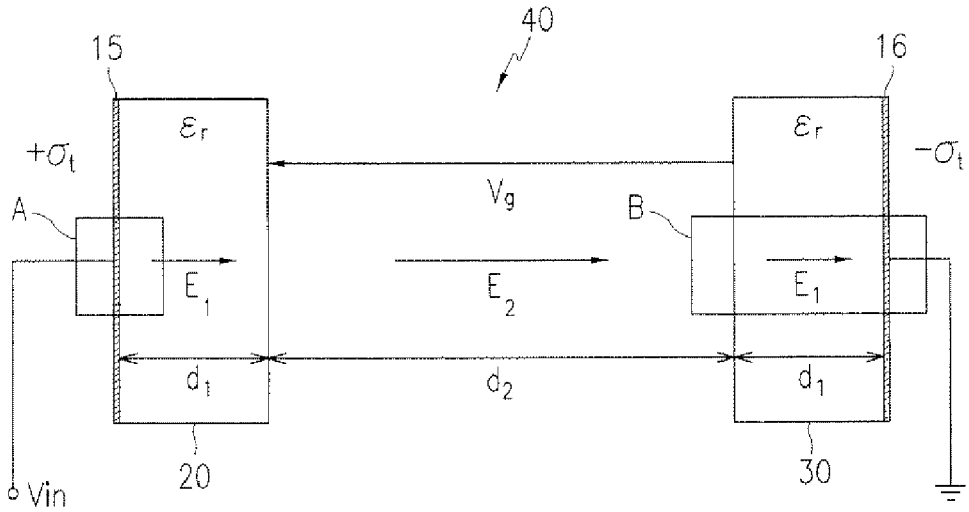
FIGS. 4, 5 and 6 show a diagram of the plasma display cell shown in FIG. 3A which shows an electric charge, wall charges and a voltage in the discharge space.

Referring to FIG. 4, areas A and B are selected through the Gaussian surface from the Maxwell equation expressed by Equation 1, shown below. Applying the Gaussian theorem to the areas A and B derives Equations 2 and 3, which determine the electric field $E_1$ in the dielectrics and the electric field $E_2$ in the discharge space, respectively.

$$\nabla \cdot D = \nabla \cdot (\epsilon E) = \sigma \quad \text{Equation 1}$$

$$E_1 = \frac{\sigma_t}{\varepsilon_\gamma \varepsilon_0} \quad \text{Equation 2}$$

where $\sigma_1$ is the charge applied to the electrodes.

$$E_2 = \frac{\sigma_t}{\varepsilon_0} \quad \text{Equation 3}$$

The externally applied voltage $V_{in}$, shown in FIG. 4, may be used to derive Equations 4 and 5, shown below.

$$2d_1E_1 + d_2E_2 = V_{in} \quad \text{Equation 4}$$

$$V_g = d_2E_2 \quad \text{Equation 5}$$

From the Equations 1 through 5, Equations 6 and 7, shown below, can be derived.

$$\sigma_t = \frac{V_{in}}{\frac{d_2}{\varepsilon_0} + \frac{2d_1}{\varepsilon_\gamma \varepsilon_0}} \quad \text{Equation 6}$$

$$V_g = d_2E_2 = d_2\frac{\sigma_t}{\varepsilon_0} = \frac{d_2}{d_2 + \frac{2d_1}{\varepsilon_\gamma}} V_{in} = \frac{\varepsilon_\gamma d_2}{\varepsilon_\gamma d_2 + 2d_1} V_{in} = \alpha V_{in} \quad \text{Equation 7}$$

where $d_2$ is much greater than $d_1$, so $\alpha$ approximates 1.

It can be seen from the Equation 7 that almost all of the externally applied voltage $V_{in}$ is applied to the discharge space.

Figure 5:
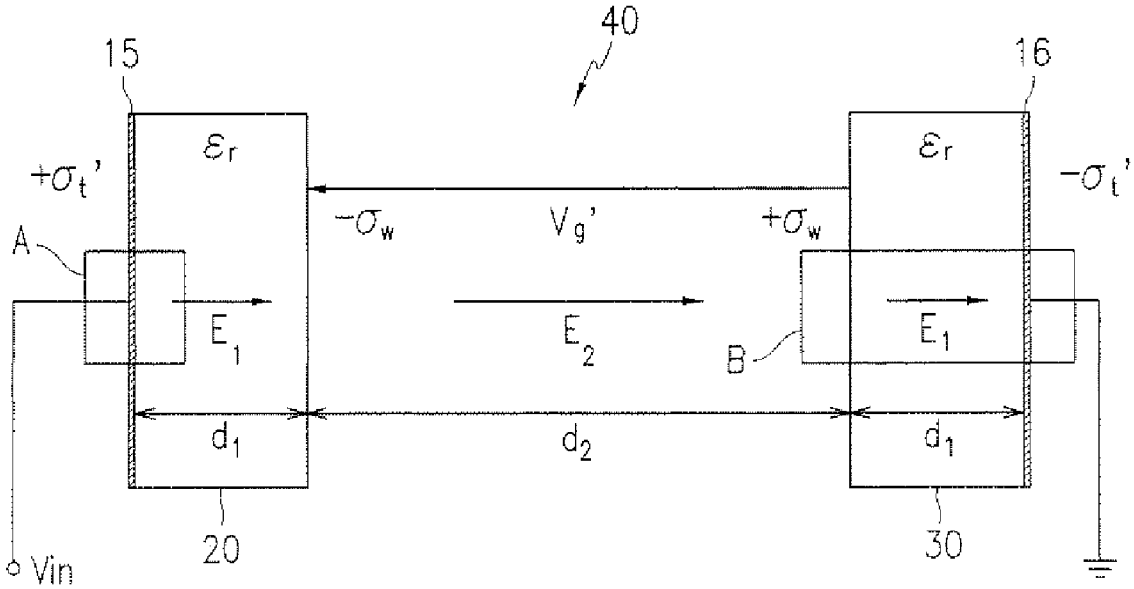

Next, reference will be made to FIG. 5 to calculate the internal voltage $V_g'$ of the discharge space when the wall charge $\sigma_w$ is formed with the voltage $V_{in}$ applied. In FIG. 5, the charge applied to the electrodes is increased to $\sigma_t'$ because the power source providing voltage $V_{in}$ supplies electric charges to the electrodes to maintain the potential of the electrodes substantially constant during the formation of the wall charge.

Referring to FIG. 5, areas A and B are selected through the Gaussian surface. Applying the Gaussian theorem to the areas A and B derives the Equations 8 and 9, shown below, which determine the electric field $E_1$ in the dielectrics 20 and 30 and the electric field $E_2$ in the discharge space, respectively.

$$E_1 = \frac{\sigma_t'}{\varepsilon_\gamma \varepsilon_0} \quad \text{Equation 8}$$

$$E_2 = \frac{(\sigma_t' - \sigma_w)}{\varepsilon_0} \quad \text{Equation 9}$$

Because $2d_1E_1 + d_2E_2 = V_{in}$ and $V_g' = d_2E_2$, Equations 10 and 11, shown below, can be derived from Equations 8 and 9.

$$\sigma_t' = \frac{V_{in} + \frac{d_2}{\varepsilon_0}\sigma_w}{\frac{d_2}{\varepsilon_0} + \frac{2d_1}{\varepsilon_\gamma \varepsilon_0}} = \frac{V_{in}}{\frac{d_2}{\varepsilon_0} + \frac{2d_1}{\varepsilon_\gamma \varepsilon_0}} + \alpha\sigma_w = \frac{\varepsilon_0}{d_2}V_g + \alpha\sigma_w \quad \text{Equation 10}$$

$$V_g' = d_2E_2 = d_2\frac{\sigma_t' - \sigma_w}{\varepsilon_0} = V_g + \frac{d_2}{\varepsilon_0}\alpha\sigma_w - \frac{d_2}{\varepsilon_0}\sigma_w = V_g - \frac{d_2}{\varepsilon_0}\sigma_w(1-\alpha) \quad \text{Equation 11}$$

As can be seen from the Equation 11, a approximates 1 when the voltage $V_{in}$ is applied, and an insignificant voltage drop occurs.

Figure 6:
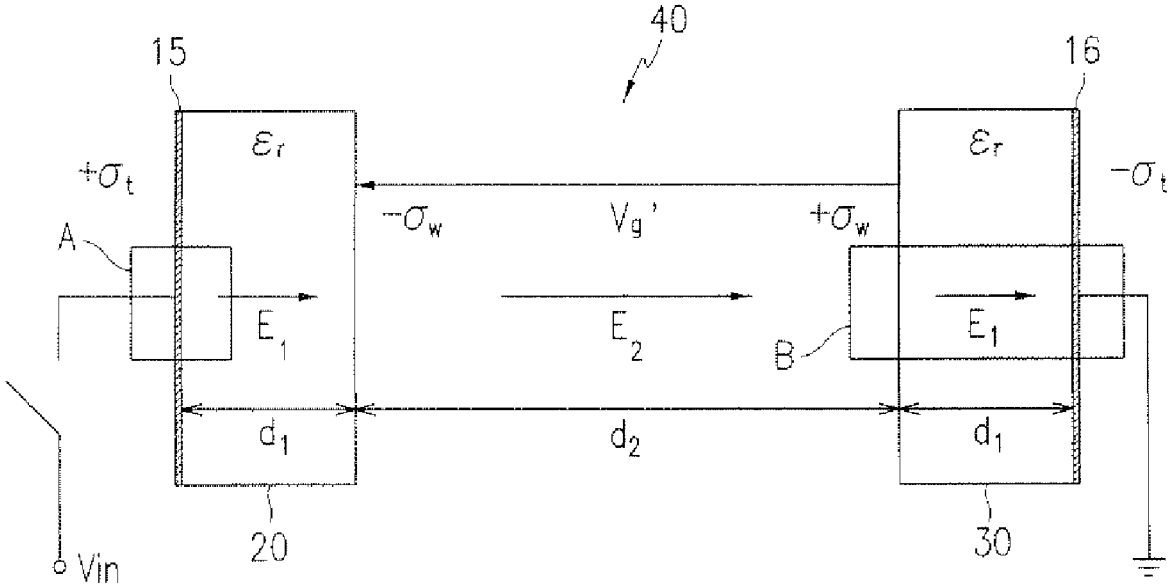

Next, reference will be made to FIG. 6 to calculate the internal voltage $V_g'$ of the discharge space when the wall charge $\sigma_w$ is formed and the electrodes are floated after application of the voltage $V_{in}$. In FIG. 6, the charge applied to the electrode becomes $\sigma_t$, because there is no electric charge supplied from the power source $V_{in}$ during the formation of the wall charge.

Referring to FIG. 6, areas A and B are selected through the Gaussian surface. Applying the Gaussian theorem to the areas A and B derives the Equations 2 and 12, shown below, which determine the electric field $E_1$ in the dielectrics and the electric field $E_2$in the discharge space, respectively.

$$E_2 = \frac{(\sigma_t - \sigma_w)}{\varepsilon_0} \quad \text{Equation 12}$$

Because $V_g' = d_2E_2$, Equation 12 can be rewritten as the following Equation 13.

$$V_g' = d_2E_2 = d_2\frac{\sigma_t - \sigma_w}{\varepsilon_0} = V_g - \frac{d_2}{\varepsilon_0}\sigma_w \quad \text{Equation 13}$$

As can be seen from Equation 13, a high voltage drop occurs due to the wall charge when the voltage $V_{in}$ is not applied (i.e., while the electrodes are in the floating state). Namely, Equations 11 and 13 show that a voltage drop caused by the wall charge when the electrodes are floating is $1/(1-\alpha)$ times greater than a voltage drop when the voltage $V_{in}$ is applied to the electrodes. Accordingly, a small quantity of wall charges that accumulate on the dielectrics when the electrodes are in a floating state rapidly reduces the internal voltage of the discharge space and functions as a rapid discharge-quenching mechanism.

This quenching mechanism is used to precisely control the wall charge in the embodiment of this invention.

Next, a description will be given as to a method for driving a PDP according to a first embodiment of the present invention.

Figure 7:
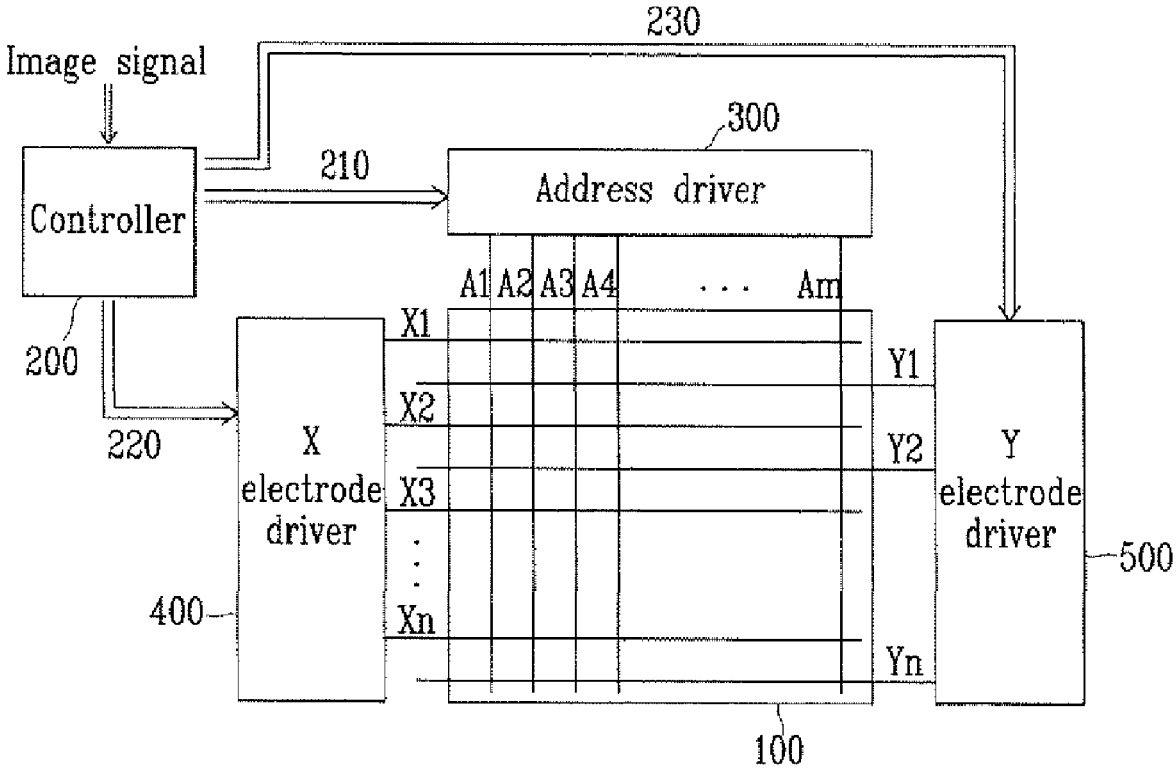
FIG. 7 is a diagram of a PDP according to an embodiment of this invention.

FIG. 7 is an illustration of a PDP according to an embodiment of the present invention.

The PDP according to the embodiment of this invention comprises a plasma panel 100, a controller 200, an address driver 300, an X electrode driver 400, and a Y electrode driver 500.

The plasma panel 100 includes a plurality of address electrodes A1 to Am arranged in columns, and a plurality of sustain electrodes X1 to Xn and scan electrodes Y1 to Yn, which are alternately arranged in rows.

The controller 200 externally receives image signals and outputs an address drive control signal 210, an X electrode drive control signal 220, and a Y electrode drive control signal 230.

The address driver 300 receives the address drive control signal 210 from the controller 200 and applies to the individual address electrodes for selection of discharge cells to be displayed.

The X electrode driver 400 receives the X electrode drive control signal 220 from the controller 200 and applies a driving voltage to the X electrodes. The Y electrode driver 500 receives the Y electrode drive control signal 230 from the controller 200 and applies a driving voltage to the Y electrodes. The X electrode driver 400 or the Y electrode driver 500 applies a predetermined voltage to the X electrodes or the Y electrodes during the reset period to cause a discharge and then floats the respective electrodes. The X electrode driver 400 or the Y electrode driver 500 also applies a sustain voltage to the X electrodes or the Y electrodes in the sustain period.

Figure 8A:
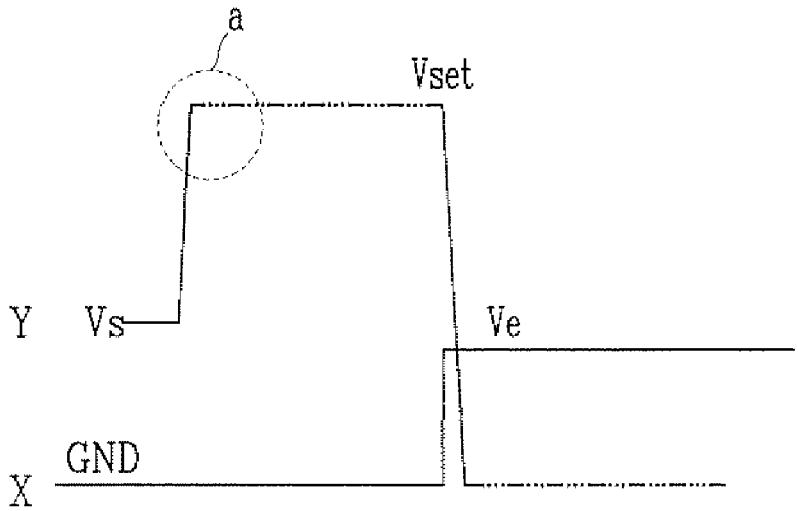
FIGS. 8A and 8B are reset waveform diagrams according to a driving method of a first embodiment of this invention.
Figure 8B:
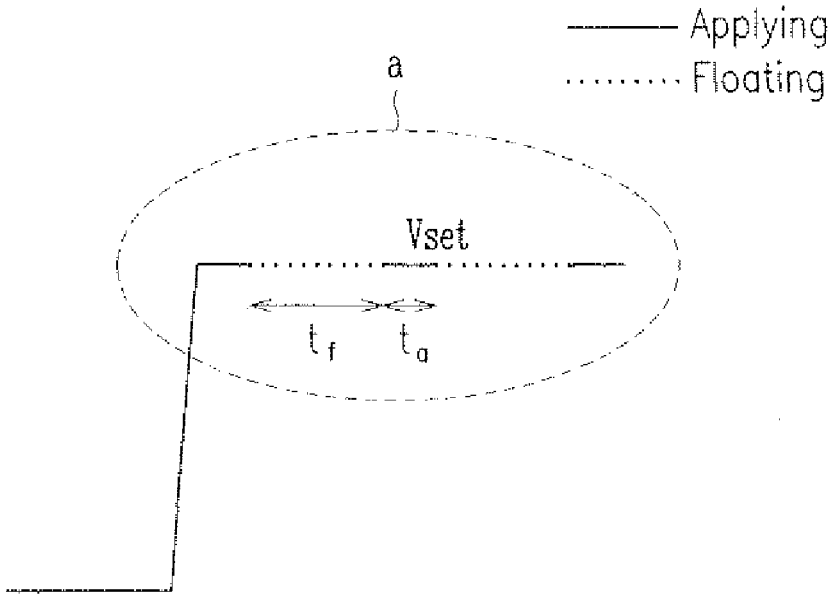

FIGS. 8A and 8B are reset waveform diagrams according to the driving method of the first embodiment of the present invention.

As illustrated in FIG. 8A, according to the reset waveform in the first embodiment of the present invention, a voltage $V_{set}$ is applied to the Y electrodes with the X electrodes sustained at the ground voltage to cause a discharge, and the Y electrodes are then floated. The voltage-applying and electrode-floating procedure is repeatedly performed a predetermined number of times to drive the Y electrodes. In this case, as shown in FIG. 8B, the voltage-applying interval $t_a$ is less than the electrode-floating interval $t_f$.

Figure 9:
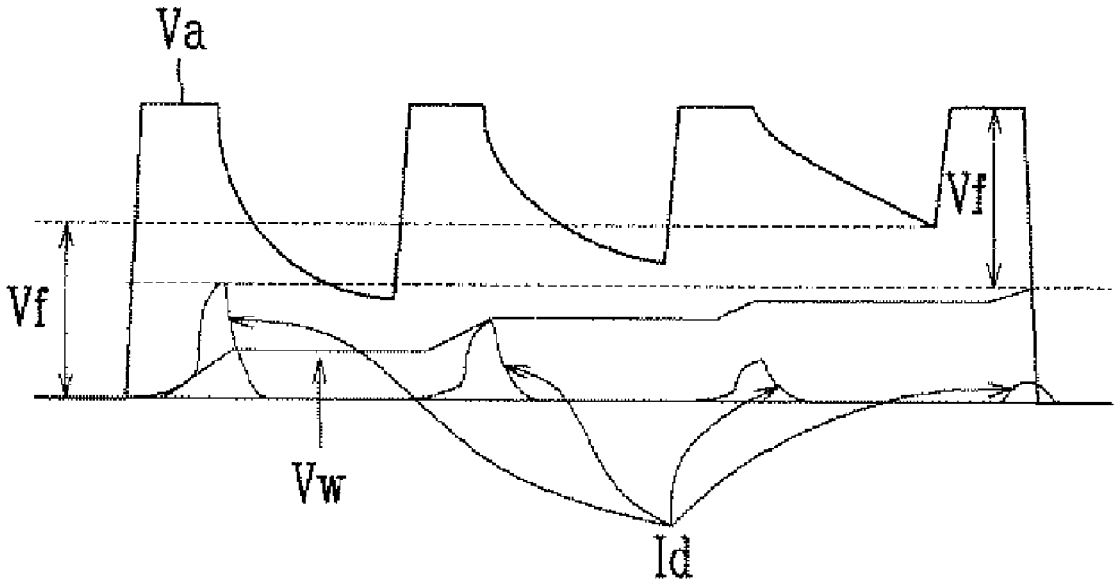
FIG. 9 is a diagram showing an electrode voltage, wall voltage, and a discharge current according to the driving method of the first embodiment of this invention.

FIG. 9 shows the difference voltage $V_a$ between the X electrodes and the Y electrodes, the wall voltage $V_w$ caused by the accumulated wall charges on the dielectric layers of the two electrodes, and the discharge current $I_d$, when the voltage-applying and electrode-floating procedure is repeatedly performed to drive the Y electrodes, as illustrated in FIGS. 8A and 8B. In the following description, the voltage $V_a$ will be considered to be the Y electrode voltage because the X electrode voltage is the ground voltage in the first embodiment of this invention.

Referring to FIG. 9, when the voltage $V_{set}$ exceeding a discharge firing voltage $V_f$ is applied to the Y electrodes to activate a discharge and the Y electrodes are then floated, a specific quantity of wall charges accumulate and an intense discharge quenching occurs in the discharge space, as described previously. With the discharge quenching in the discharge space, the Y electrode voltage $V_a$ decreases. Subsequently, the voltage $V_{set}$ is applied to the Y electrodes to cause a second discharge and the Y electrodes are then floated, accumulating a specific quantity of wall charges and causing an intense discharge quenching in the discharge space. The voltage-applying and electrode-floating procedure is repeatedly performed a predetermined number of times.

As can be seen from FIG. 9, the quantity of discharge (i.e., the magnitude of the discharge current) in the discharge space slowly decreases. This is because the discharge current $I_d$ flowing in the discharge space is proportional to the difference between the Y electrode voltage $V_a$ and the wall voltage $V_w$. As the voltage-applying and electrode-floating procedure is repeatedly performed to drive the Y electrodes, as shown in FIG. 9, the wall voltage $V_w$ caused by the wall charges accumulated on the dielectric layers of the two electrodes increases, and the difference between the Y electrode voltage $V_a$ and the wall voltage $V_w$ decreases, thereby reducing the discharge current $I_d$. In the meantime, the wall charges are accumulated until the voltage (i.e., the voltage difference between $V_a$ and $V_w$) applied to the discharge space reaches the discharge firing voltage $V_f$.

The first embodiment of this invention, as described above, rapidly quenches the discharge with a small quantity of wall charges by applying a predetermined voltage $V_{set}$ to the Y electrodes and then floating the Y electrodes to drive the Y electrodes. In this manner, the wall charges can be controlled precisely. For controlling the wall charges, according to the first embodiment of this invention, the voltage-applying time $t_a$ should not be long enough to cause an excessively intense discharge.

In addition, the first embodiment of the present invention allows stable control for the wall charges through a second discharge because the first discharge is the most intense. In an embodiment of this invention, the Y electrodes may be driven with the voltage-applying time (i.e., the turn-in time) and the floating time (i.e., the turn-off time) set to cause at least two discharge times.

Next, a description will be given as to a driving method according to a second embodiment of this invention.

Figure 10:
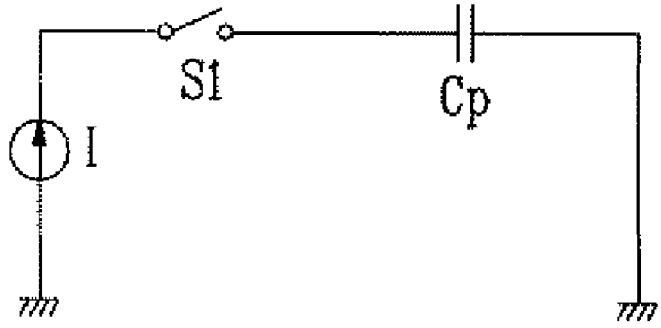
FIG. 10 is a conceptual diagram of a circuit implementing a driving method according to a second embodiment of this invention.

FIG. 10 is a conceptual diagram of a circuit implementing the reset method according to the second embodiment of this invention.

Referring to FIG. 10, a current source I for flowing a constant current is coupled to a panel capacitor $C_P$ through a switch $S_1$. The panel capacitor $C_P$ is equivalent to two electrodes of the Y electrodes, the X electrodes and the address electrodes. The voltage applied to the one electrode of the panel capacitor $C_P$ with the switch on is given by the following equation:

$$V=\pm(I/C_x)\cdot t \qquad \text{Equation 14}$$

where $C_X$ represents the capacitance of the panel capacitor $C_P$; and the signs (+) and (−) are determined according to the direction of the current supplied from the current source I.

As can be seen from Equation 14, a ramp waveform rising with a slope of $I/C_X$ is applied to the panel capacitor Cp in the second embodiment of this invention.

The reset method according to the second embodiment of the present invention involves applying a ramp waveform rapidly rising or rapidly falling for a predetermined time period to the one electrode of the panel capacitor to cause a discharge in the panel capacitor (i.e., a discharge space between the two electrodes) and then floating the one electrode of the panel capacitor to quench the discharge in the discharge space.

The circuit components corresponding to the current source I and the switch $S_1$ in the equivalent circuit of FIG. 10 can be presented in at least one of the X electrode driver 400, the Y electrode driver 500 and the address driver 300 of the plasma display panel shown in FIG. 7. The specific circuit of the current I and the switch $S_1$ in the equivalent circuit of FIG. 10 are well known to those skilled in the art and will not be described.

Figure 11:
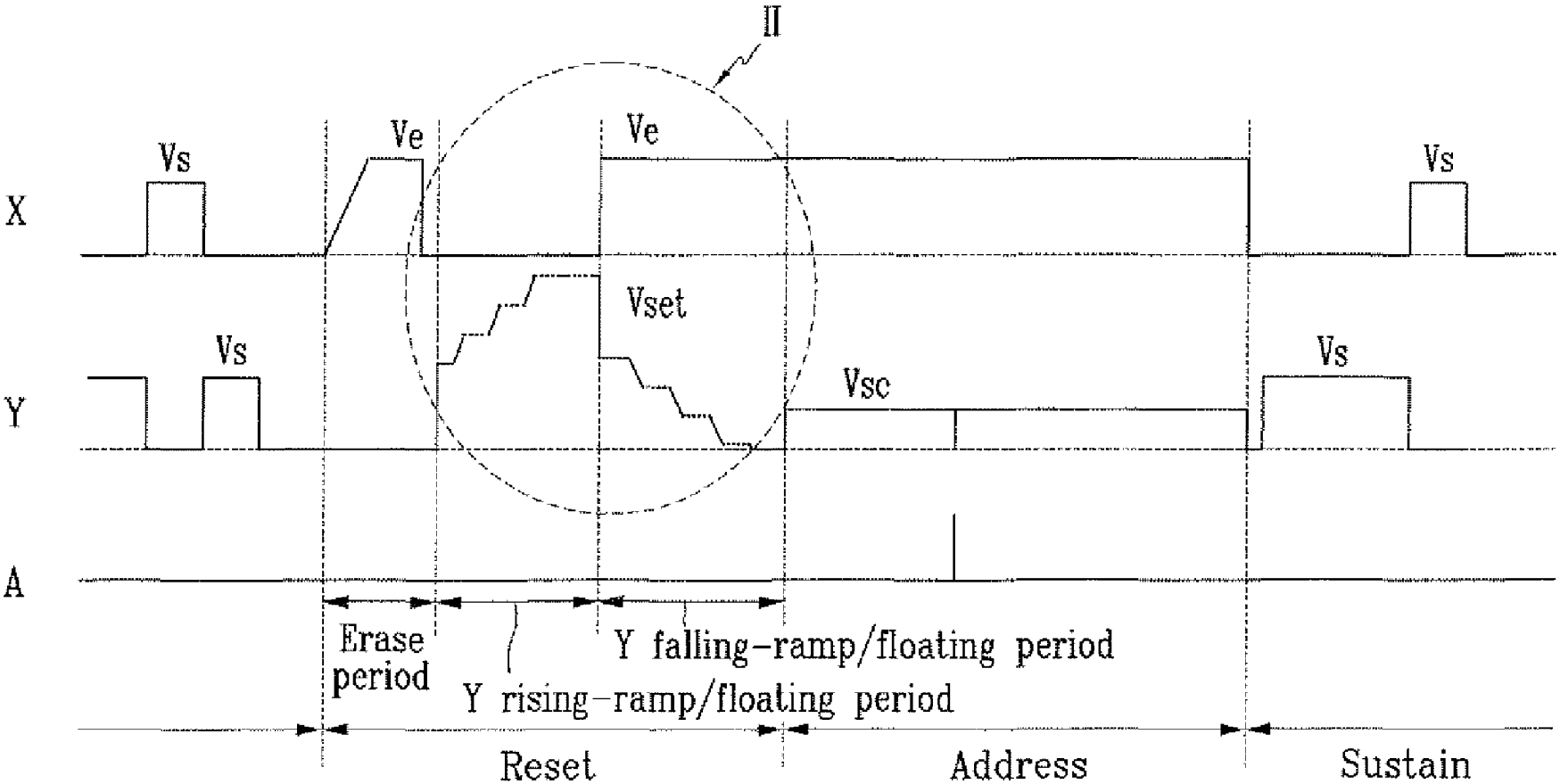
FIG. 11 is a waveform diagram according to the driving method of the second embodiment of this invention.

FIG. 11 is a driving waveform diagram according to the second embodiment of the present invention. Referring to FIG. 11, the reset period comprises an erase interval, a Y rising-ramp/floating interval, and a Y falling-ramp/floating interval. A brief description of each of the intervals is provided below.

(1) Erase Interval

After the completion of the sustain period, positive (+) and negative (−) charges are accumulated on the dielectrics formed on the X and Y electrodes, respectively. With the Y electrodes sustained at a predetermined voltage (e.g., the ground voltage) after the sustain, a ramp voltage rising from 0(V) to +Ve(V) is applied to the X electrodes. Then the wall charges accumulated on dielectrics formed with the X and Y electrodes are erased slowly.

(2) Y Rising-Ramp/Floating Interval

With the address electrodes and the X electrodes sustained at 0V, a ramp-rising/floating voltage for repeatedly performing the procedure of rising ramp from $V_s$ to $V_{set}$ and then floating the Y electrodes is applied to the Y electrodes. A reset discharge occurs in all the discharge cells to accumulate wall charges while the rapidly rising ramp voltage is applied to the Y electrodes, and the discharge in the discharge space is rapidly quenched while the Y electrodes are floated.

(3) Y Falling-Ramp/Floating Interval

With the X electrodes sustained at a constant voltage $V_e$, a falling-ramp/floating voltage for repeatedly performing the procedure of falling ramp from $V_{s\ to\ v0}$ and then floating the Y electrodes is applied to the Y electrodes.

Figure 12A:
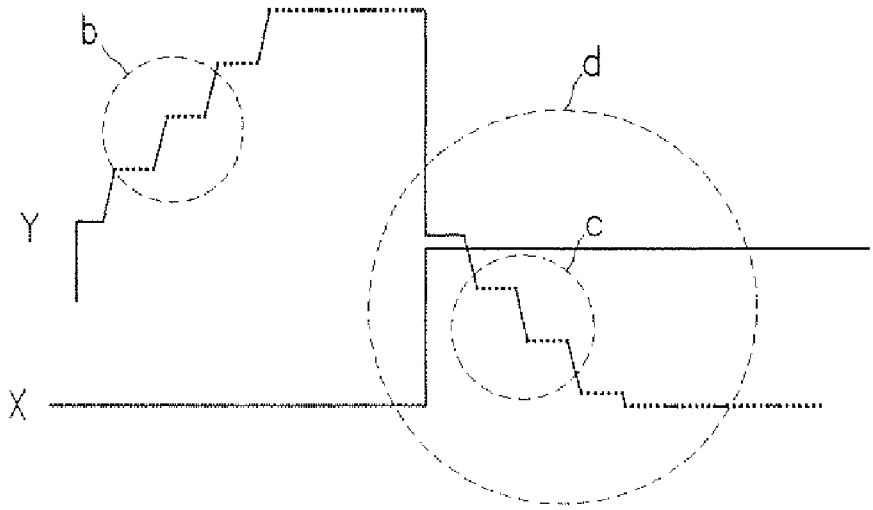
FIGS. 12A, 12B and 12C are detailed diagrams of the reset waveform of FIG. 11.
Figure 12B:
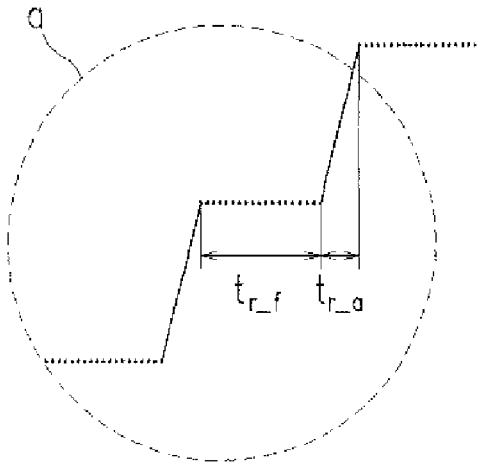
Figure 12C:
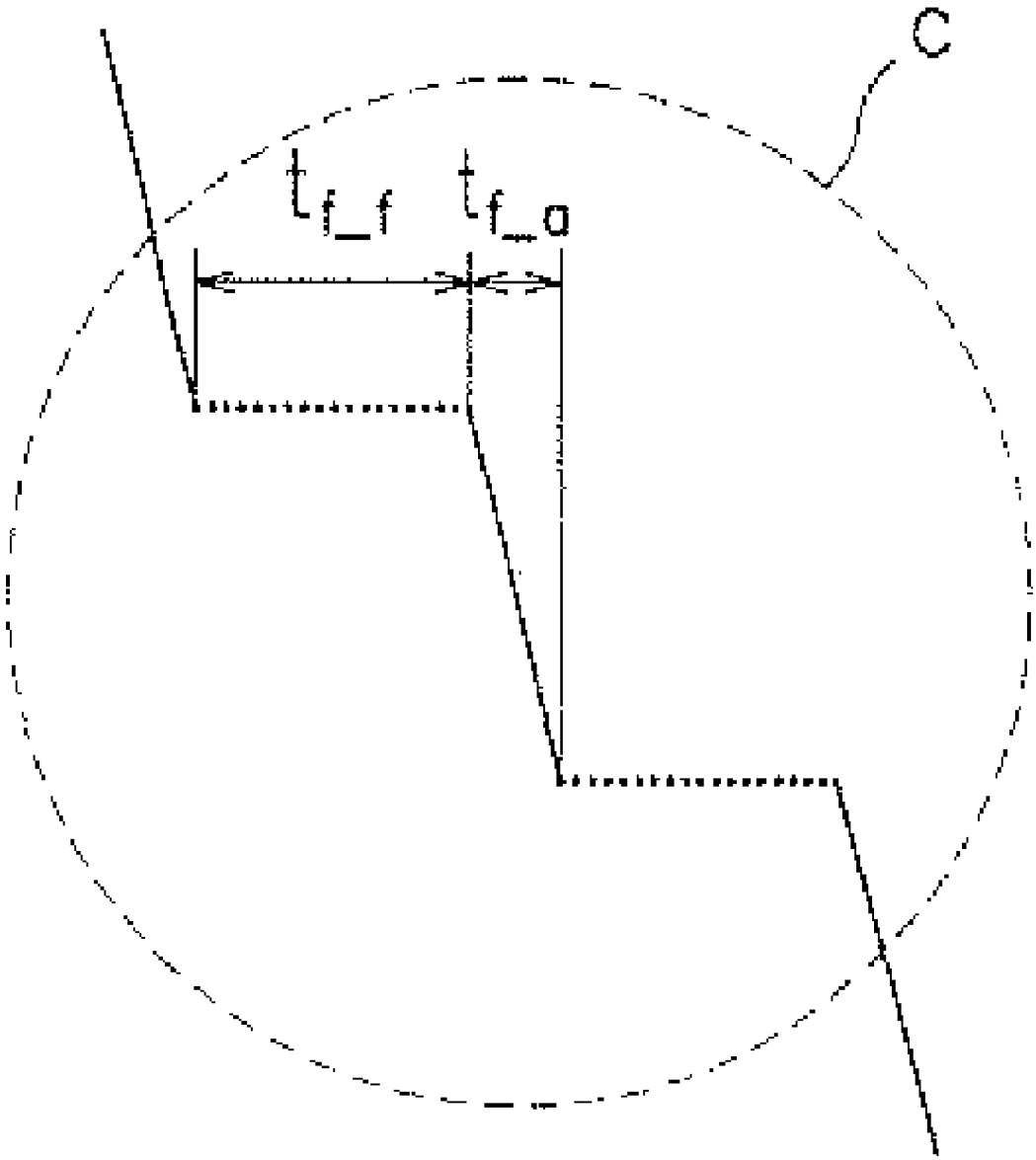

FIG. 12A is an enlarged diagram of the area II of the reset period shown in FIG. 11, i.e., the Y rising-ramp/floating interval and the Y falling-ramp/floating interval; and FIGS. 12B and 12C are enlarged diagrams of the areas b and c in FIG. 12A, respectively.

In FIGS. 12B and 12C, the time $t_{r_a}$ for applying the rising ramp voltage to the Y electrodes and the time $t_{f_a}$ for applying the falling ramp voltage to the Y electrodes are preferably less than the times $t_{r_f}$ and $t_{f_f}$ for floating the Y electrodes, respectively. When the time-varying voltage is applied to Y electrodes (that is, panel capacitor), electric charge is supplied in the discharge space, thereby quenching the stored wall charge less. Therefore, it is desirable that the time-varying voltage with sharp slope is applied to the electrodes.

In the second embodiment, the slope of the time-varying voltage is greater than 10V/μsec.

Figure 13A:
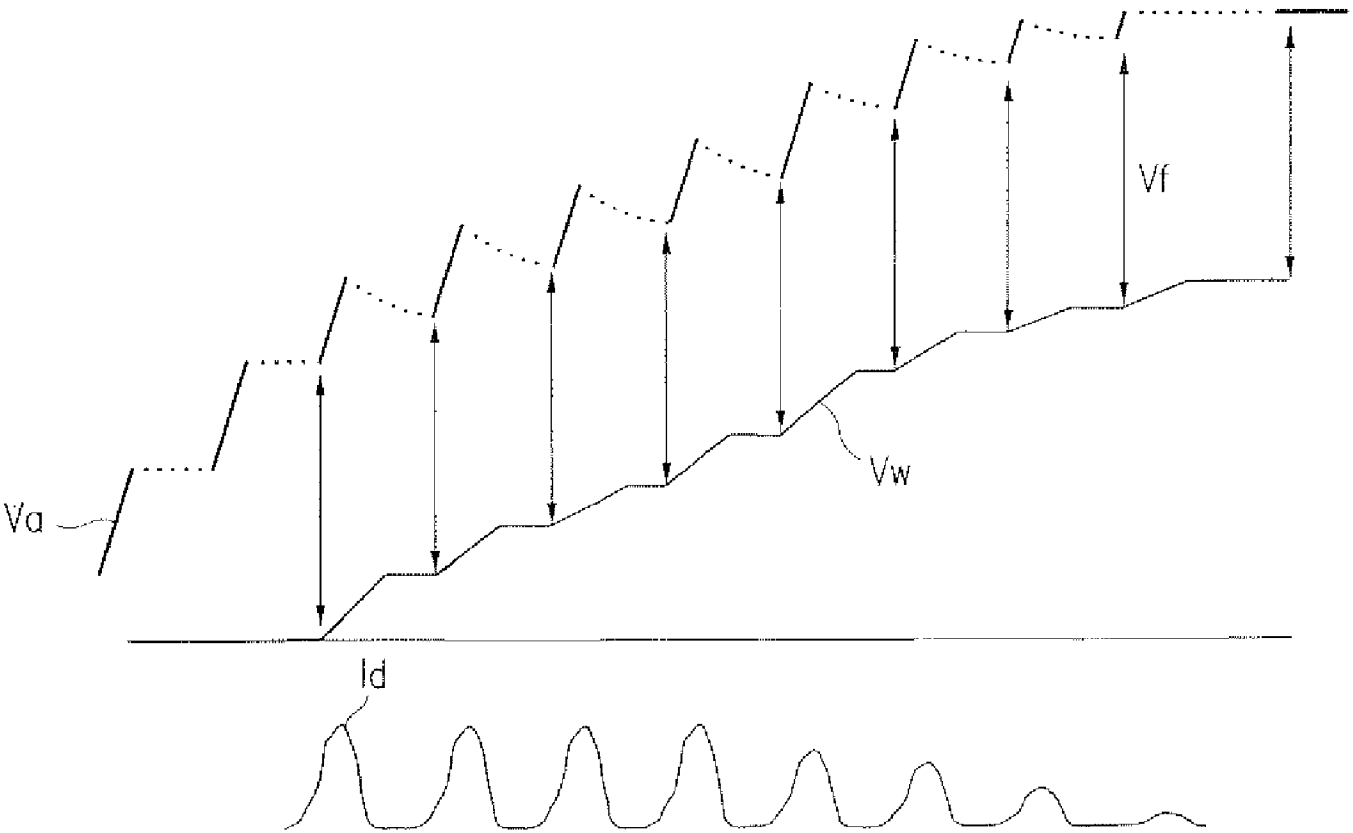
FIGS. 13A and 13B are diagrams showing an electrode voltage, wall voltage, and a discharge current according to the driving method of the second embodiment of this invention.

FIG. 13A shows the difference voltage $V_a$ between the X and Y electrodes, the wall voltage $V_w$ caused by wall charges accumulated on the dielectrics formed with the two electrodes, and the discharge current $I_d$ in the Y rising-ramp/floating interval according to the second embodiment of the present invention. In the following description, for exemplary purposes, the voltage $V_a$ is considered as the Y electrode voltage in the second embodiment of the present invention because the X electrode voltage is the ground voltage in the Y rising-ramp/floating interval.

As illustrated in FIG. 13A, when a ramp voltage exceeding the discharge firing voltage $V_f$ is applied to the Y electrodes to cause a discharge and the Y electrodes are then floated, a specific quantity of wall charges are accumulated and an intense discharge quenching occurs in the discharge space, as described previously. With the discharge quenching in the discharge space, the Y electrode voltage $V_a$ decreases. Subsequently, the ramp voltage is applied to the Y electrodes a second time and then the Y electrodes are floated, thereby accumulating a specific quantity of wall charges and causing an intense discharge quenching in the discharge space. The voltage-applying and electrode-floating procedure is repeatedly performed a predetermined number of times.

As can be seen from FIG. 13A, the quantity of discharge (i.e., the magnitude of the discharge current) in the discharge space is more constant in the second embodiment of this invention than in the first embodiment. This is because the voltage $V_a$ applied to the Y electrodes as well as the wall voltage $V_w$ caused by the wall charges accumulated on the dielectrics formed with the two electrodes increases as the voltage-applying and electrode-floating procedure repeats, thus maintaining the difference between the Y electrode voltage $V_a$ and the wall voltage $V_w$ to be more constant as compared with the case of the first embodiment of this invention.

Accordingly, the reset method of the second embodiment of the present invention can control the wall charge more precisely than the first embodiment of the present invention.

Figure 13B:
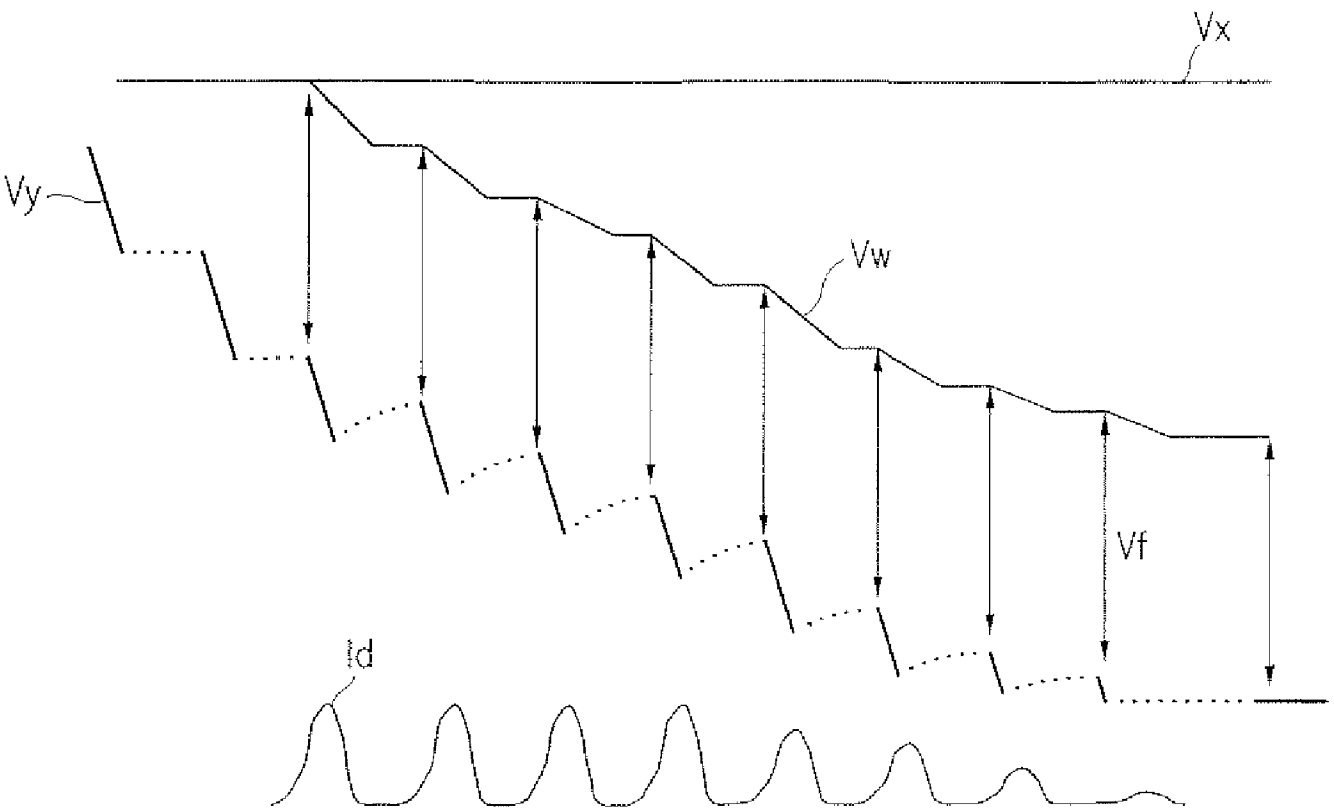

FIG. 13B shows the X electrode voltage $V_x$, the Y electrode voltage $V_y$, the wall voltage $V_w$ caused by wall charges accumulated on the dielectrics formed with the two electrodes, and the discharge current $I_d$ in the Y falling-ramp/floating interval according to the second embodiment of the present invention. In the Y falling-ramp/floating interval, a bias voltage $V_x$ higher than the Y electrode voltage is applied to the X electrodes.

As illustrated in FIG. 13B, a rapidly falling ramp voltage is applied to the Y electrodes to cause a discharge such that the difference between the X electrode voltage $V_x$ and the Y electrode voltage $V_y$ exceeds the discharge firing voltage $V_f$, and then the Y electrodes are floated to reduce the wall charges previously accumulated and to cause an intense discharge quenching in the discharge space. The Y electrode voltage $V_y$ increases with the discharge quenching in the discharge space. Subsequently, a falling ramp voltage is applied to the Y electrodes to cause a discharge and then the Y electrodes are floated, decreasing further wall charges and causing an intense discharge quenching in the discharge space. As the voltage-applying and electrode-floating procedure is repeatedly performed a predetermined number of times, a specific quantity of wall charges accumulate on the dielectrics formed on the X and Y electrodes, as illustrated in FIG. 13B.

Accordingly, the wall charges accumulated on the dielectrics formed with the two electrodes can be controlled to be in a desired state by repeatedly performing the voltage-applying and electrode-floating procedure as in the second embodiment of this invention.

As described above, the reset method according to the embodiment of this invention controls the wall charge accumulated on the dielectrics formed with the electrodes by applying a voltage and then floating the electrodes. Some exemplary advantages of this invention are discussed below.

The conventional reset method is a sort of feedback method that basically applies a voltage to cause a discharge for accumulation of wall charges and reduces the internal voltage when the wall charges are sufficiently accumulated to quench the discharge. Contrarily, the reset method using the floating state of the electrodes according to the embodiment of the present invention is a more effective feedback method that rapidly reduces the internal voltage with a small quantity of wall charges accumulated by floating the electrodes to cause a discharge quenching. Namely, the present invention quenches the discharge with a much smaller quantity of accumulated wall charges to allow a precise control of the wall charges, as compared with the conventional method.

The conventional reset method of applying a ramp voltage slowly increases the voltage applied to the discharge space with a constant voltage variation to prevent an intense discharge and control the wall charge. This conventional method using the ramp voltage controls the intensity of the discharge with the slope of the ramp voltage and requires a restricted condition for the slope of the ramp voltage to control of the wall charge, taking too much time for the reset operation. Contrarily, the reset method using the floating state according to the embodiment of the present invention controls the intensity of the discharge using a voltage drop based on the wall charge, reducing the required time.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

Although the Y electrodes are floated to quench the discharge in the embodiment of the present invention, for example, any other electrode can be floated. In addition, the rising/falling ramp waveforms are used in the embodiment of this invention, but any other rising/falling waveform can be used.

As described above, this invention enables the precise control of wall charges and shortens the required time of the reset period.

What is claimed is:

1. A method for driving a plasma display panel which includes a first electrode, a second electrode, a third electrode, and a discharge space defined by the first electrode, the second electrode, and the third electrode, the method comprising:

applying a first voltage to the first electrode to discharge the discharge space;

floating the first electrode; and biasing the second electrode to a second voltage while applying the first voltage to the first electrode and floating the first electrode, wherein the first electrode is a scan electrode, and the second electrode is a sustain electrode, and wherein the first electrode is floated by isolating the first electrode from a power source.

2. The method of claim 1, wherein a duration for floating the first electrode is longer than a duration for applying the first voltage to the first electrode.

3. The method of claim 1, wherein the first electrode and the second electrode are disposed parallel to each other on a first substrate of the plasma display panel and the third electrode is disposed on a second substrate of the plasma display panel.

4. The method of claim 1, wherein the floating step is performed after the applying a first voltage step.

5. The method of claim 1, further comprising repeating the applying a first voltage step and the floating step.

6. The method of claim 5, wherein the first voltage is a time-varying voltage.

7. The method of claim 5, wherein a discharge current flowing in the discharge space during an n-th applying a first voltage step is greater than a discharge current flowing in the discharge space during an (n+1)-th applying a first voltage step, wherein n is an integer corresponding to an ordinal number in a series of repeating the applying the first voltage step and the floating step.

8. A method for driving a plasma display panel, which includes a first space defined by a first electrode, a second electrode and a third electrode, the method comprising:

applying a time-varying voltage to the first electrode to discharge the first space;

floating the first electrode after applying the time-varying voltage; and biasing the second electrode to a first voltage while applying the time-varying voltage to the first electrode and floating the first electrode, wherein the first electrode is a scan electrode, and the second electrode is a sustain electrode, and wherein the first electrode is floated by isolating the first electrode from a rower source.

9. The method of claim 8, further comprising repeating the applying a time-varying voltage step and the floating step.

10. The method of claim 8, wherein the first electrode and the second electrode are disposed parallel to each other on a first substrate of the plasma display panel and the third electrode is disposed on a second substrate of the plasma display panel.

11. A method for driving a plasma display panel, which includes a first space defined by a scan electrode, a sustain electrode, and an address electrode, the method comprising:

during a reset period, applying a rising voltage to the scan electrode;

floating the scan electrode after applying the rising voltage to the scan electrode;

applying a falling voltage to the scan electrode;

floating the scan electrode after applying the falling voltage to the scan electrode;

biasing the sustain electrode to a first voltage while applying the rising voltage to the scan electrode and floating the scan electrode after applying the rising voltage to the scan electrode; and biasing the sustain electrode to a second voltage while applying the falling voltage to the scan electrode and floating the scan electrode after applying the falling voltage to the scan electrode, wherein the scan electrode is floated by isolating the scan electrode from a rower source.

12. The method of claim 11, further comprising repeating the applying a rising voltage step and the floating the scan electrode after applying the rising voltage to the scan electrode step.

13. The method of claim 11, further comprising repeating the applying a falling voltage step and the floating the scan electrode after applying the falling voltage to the scan electrode step.

14. The method of claim 11, wherein the scan electrode and the sustain electrode are disposed parallel to each other on a first substrate of the plasma display panel and the address electrode is disposed on a second substrate of the plasma display panel.

15. The method of claim 11, wherein the first space is discharged in the applying a rising voltage step and the applying a falling voltage step.

16. A method for driving a plasma display panel, which includes a first space defined by a first electrode, a second electrode and a third electrode, the method comprising:

during a reset period, performing a first discharge in the first space;

quenching the first discharge by floating the first electrode while biasing the second electrode to a first voltage, the first electrode being a scan electrode, and the second electrode being a sustain electrode;

performing a second discharge in the first space;

quenching the second discharge; and biasing the second electrode to a second voltage while performing the first discharge, quenching the first discharge, performing the second discharge, and quenching the second discharge, wherein the first electrode is floated by isolating the first electrode from a rower source.

17. The method of claim 16, wherein the first electrode and the second electrode are disposed parallel to each other on a first substrate of the plasma display panel and the third electrode is disposed on a second substrate of the plasma display panel.

18. The method of claim 16, wherein wall charges accumulate on a dielectric, formed on at least one of the first electrode and the second electrode in the performing a first discharge step and the performing a second discharge step.

19. The method of claim 16, wherein a magnitude of a discharge current generated in the first space during the performing a first discharge step is greater than a magnitude of the discharge current generated in the first space during the performing a second discharge step.

20. The method of claim 16, wherein the first electrode is floated in the quenching the first discharge step and the quenching the second discharge step.

21. The method of claim 16, wherein wall charges accumulated on a dielectric, formed on at least one of the first electrode and the second electrode, decrease in the performing a first discharge step and the performing a second discharge step.

22. The method of claim 16, further comprising repeating the performing a second discharge step and the quenching the second discharge step.

23. A plasma display panel, comprising:

a first substrate and a second substrate;

a scan electrode, a sustain electrode, and an address electrode;

a first space defined by the scan electrode, the sustain electrode, and the address electrode; and a driver circuit to send a driving signal to the scan electrode, the sustain electrode, and the address electrode during a reset period, an address period, and a sustain period, the driver circuit, during the reset period, to apply a time-varying voltage to the scan electrode to discharge the first space, and then to float the scan electrode, and to bias the sustain electrode to a first voltage while applying the time-varying voltage to the scan electrode and floating the scan electrode, wherein the scan electrode is floated by isolating the scan electrode from a rower source.

24. The plasma display panel of claim 23, wherein the scan electrode and the sustain electrode are disposed parallel to each other on the first substrate and the address electrode is disposed on the second substrate.

25. The plasma display panel of claim 23, wherein the driver circuit performs floating the scan electrode after applying a time-varying voltage to the scan electrode to discharge the first space.

26. The plasma display panel of claim 23, wherein the driver circuit drives the first electrode to repeat applying the time-varying voltage to the scan electrode to discharge the first space and floating the scan electrode.

27. The plasma display panel of claim 23, wherein the time-varying voltage is a falling ramp voltage.

28. The plasma display panel of claim 23, wherein the time-varying voltage is a rising ramp voltage.

* * * * *